US009812754B2

(12) United States Patent
Parsche

(10) Patent No.: US 9,812,754 B2
(45) Date of Patent: Nov. 7, 2017

(54) DEVICES WITH S-SHAPED BALUN SEGMENT AND RELATED METHODS

(71) Applicant: HARRIS CORPORATION, Melbourne, FL (US)

(72) Inventor: Francis Eugene Parsche, Palm Bay, FL (US)

(73) Assignee: HARRIS CORPORATION, Melbourne, FL (US)

( * ) Notice: Subject to any disclaimer, the term of this patent is extended or adjusted under 35 U.S.C. 154(b) by 184 days.

(21) Appl. No.: 14/633,583

(22) Filed: Feb. 27, 2015

(65) Prior Publication Data

US 2016/0254584 A1 Sep. 1, 2016

(51) Int. Cl.

| | |
|---|---|
| ***H01P 11/00*** | (2006.01) |
| ***H01P 5/10*** | (2006.01) |
| ***H01Q 1/50*** | (2006.01) |

(52) U.S. Cl.
CPC *H01P 5/10* (2013.01); *H01Q 1/50* (2013.01)

(58) Field of Classification Search
CPC ..... H01Q 1/325; H01Q 9/0407; H01P 5/10
USPC ..... 343/711, 793, 859
See application file for complete search history.

(56) References Cited

U.S. PATENT DOCUMENTS

| | | | | |
|---|---|---|---|---|
| 2,472,106 | A | 6/1949 | Hansen | |
| 3,576,578 | A | 4/1971 | Harper | |
| 4,032,850 | A * | 6/1977 | Hill | H03D 9/0625 333/26 |
| 4,149,170 | A | 4/1979 | Campbell et al. | |
| 4,160,210 | A | 7/1979 | Moninari | |
| 4,217,589 | A | 8/1980 | Stahler | |
| 4,442,438 | A | 4/1984 | Siwiak et al. | |
| 4,504,834 | A | 3/1985 | Garay et al. | |
| 4,764,773 | A | 8/1988 | Larsen et al. | |
| 4,800,395 | A | 1/1989 | Balzano et al. | |
| 4,940,989 | A | 7/1990 | Austin | |
| 5,231,412 | A | 7/1993 | Eberhardt et al. | |
| 5,262,740 | A | 11/1993 | Willems | |
| 5,300,940 | A | 4/1994 | Simmons | |
| 5,489,912 | A | 2/1996 | Holloway | |
| 5,559,524 | A | 9/1996 | Takei et al. | |
| 5,563,615 | A | 10/1996 | Tay et al. | |

(Continued)

OTHER PUBLICATIONS

Deguchi et al., "A Compact Low-Cross-Polarization Horn Antenna With Serpentine-Shaped Taper," IEEE 2001, pp. 320-323.

(Continued)

*Primary Examiner* — Hoang Nguyen
*Assistant Examiner* — Jae Kim
(74) *Attorney, Agent, or Firm* — Allen, Dyer, Doppelt, Gilchrist, P.A. Attorneys at Law

(57) ABSTRACT

An electronic device may include a wireless circuit, and a coaxial cable device having an S-shaped balun segment coupled to the wireless circuit, and an antenna segment coupled to the S-shaped balun segment. The S-shaped balun segment may include a first inner conductor segment, and a first outer conductor segment surrounding the first inner conductor segment. The antenna segment may include a second inner conductor segment coupled to the first inner conductor segment, and a second outer conductor segment surrounding the second inner conductor segment and coupled to the first outer conductor segment, the second inner conductor segment extending from the second outer conductor segment.

22 Claims, 12 Drawing Sheets

(56) References Cited

U.S. PATENT DOCUMENTS

| | | | | |
|---|---|---|---|---|
| 5,844,525 | A | 12/1998 | Hayes et al. | |
| 5,886,672 | A | 3/1999 | Brune et al. | |
| 5,949,383 | A | 9/1999 | Hayes et al. | |
| 5,999,132 | A | 12/1999 | Kitchener et al. | |
| 6,204,825 | B1 | 3/2001 | Wilz | |
| 6,294,965 | B1 | 9/2001 | Merrill et al. | |
| 7,079,081 | B2 | 7/2006 | Parsche et al. | |
| 7,102,578 | B2 | 9/2006 | Minemura | |
| 7,151,497 | B2 | 12/2006 | Crystal | |
| 7,215,289 | B2 | 5/2007 | Harano | |
| 7,302,249 | B1 | 11/2007 | Fudem et al. | |
| 7,468,640 | B2 | 12/2008 | Nosaka | |
| 7,952,530 | B1 | 5/2011 | Gerhard | |
| 7,978,024 | B2 | 7/2011 | Cheng | |
| 8,552,311 | B2 | 10/2013 | Koester et al. | |
| 8,552,913 | B2 | 10/2013 | Ayatollahi et al. | |
| 8,570,223 | B2 | 10/2013 | Arslan et al. | |
| 8,585,377 | B2 | 11/2013 | Kamen et al. | |
| 8,589,026 | B2 | 11/2013 | Holt et al. | |
| 2004/0012530 | A1 | 1/2004 | Chen | |
| 2005/0007283 | A1 | 1/2005 | Jo et al. | |
| 2005/0040991 | A1 | 2/2005 | Crystal | |
| 2005/0052331 | A1* | 3/2005 | Rauch | H01Q 9/16 343/821 |
| 2006/0022891 | A1 | 2/2006 | ONeill et al. | |
| 2006/0055408 | A1* | 3/2006 | Sambandamurthy | G01R 33/3685 324/322 |
| 2007/0188397 | A1 | 8/2007 | Parsche | |
| 2011/0121822 | A1 | 5/2011 | Parsche | |
| 2013/0009835 | A1* | 1/2013 | Yoshino | H01Q 1/3291 343/792 |

OTHER PUBLICATIONS

Deguchi et al., "Compact Low-Cross-Polarization Horn Antennas With Serpentine-Shaped Taper," IEEE Transactions on Antennas and Propagation, vol. 52, No. 10, Oct. 2004, pp. 2510-2516.

Huang et al., "A Novel High-Reliable Platform for Wireless Sensor Networks With Serpentine-Antenna Design," International Conference on Complex, Intelligent and Software Intensive Systems, IEEE 2009, pp. 577-283.

Sanjay et al, "Effect of Serpentine and Non-Uniform Waveguide Mode Converters on TM01 and TE11: A Comparative Study Based on Simulations," IEEE 2011, 5 pages.

Tuan et al., "A Highly Reliable Platform with a Serpentine Antenna for IEEE 802.15.4 over a Wireless Sensor Network," WSEAS Transactions on Circuits and Systems, Issue 6, vol. 11, Jun. 2012, pp. 182-195.

Elkamchouchi, "The S-Shaped Dipole Antenna," International Conference on Microwave and Millimeter Wave Technology Proceedings, 2014, pp. 19-22.

Frank's N4SPP Ham Radio home-built shorty cobra folded dipole antenna, "¼-size Cobra folded-dipole antenna," May 13, 2014, pp. 1-16.

* cited by examiner

XZ PLANE

YZ PLANE

XY PLANE

DEVICES WITH S-SHAPED BALUN SEGMENT AND RELATED METHODS

TECHNICAL FIELD

The present disclosure relates to the field of electronic devices, and, more particularly, to balun device for the electronic devices and related methods.

BACKGROUND

A balun is a transformer that can convert electrical signals that are balanced to signals that are unbalanced, and vice versa. For example, the balanced signal may be balanced about a ground (i.e. differential) while the unbalanced signal may comprise a single-ended signal. Moreover, the balun may be used to match couplings between connections of varying impedances.

One typical application for a balun is a dipole antenna feed structure. In particular, the balanced load of the dipole antenna is center fed with a coaxial transmission line, which is unbalanced due to the differences between the inner and outer conductor. More specifically, the signals in the inner and outer conductors of the coaxial transmission line propagate differently since they travel paths of different resistances. The transmission line application is well suited for one common example of a balun, i.e. the transmission line balun. Typically, this balun may comprise a ferromagnetic body, such as a toroid or bar, and the transmission line is wrapped around the ferromagnetic body. In coaxial applications, such as antenna feeds and PC cable connections, the donut shaped ferromagnetic body surrounds the transmission line.

Coaxial cable has become ubiquitous, yet the unbalanced nature of the coaxial transmission line may suffer from the unwanted effect known as common mode current. The common mode current is energy that travels on the outer surface of the coaxial cable outer conductor. This common mode current may cause undesirable interference, and reduce transmission efficiency. The typical balun acts as a "choke" and impedes flow of this common mode current, i.e. a balun choke.

In some applications where the antenna is mounted to extend from a largely metallic chassis, the common mode current passes through to the metallic chassis. In these applications, the metallic chassis may operate as a poor ground plane.

SUMMARY

In view of the foregoing background, it is therefore an object of the present disclosure to provide an electronic device with an efficient and effective antenna.

This and other objects, features, and advantages in accordance with the present disclosure are provided by an electronic device that may comprise a wireless circuit, and a coaxial cable device comprising an S-shaped balun segment coupled to the wireless circuit, and an antenna segment coupled to the S-shaped balun segment. The S-shaped balun segment may comprise a first inner conductor segment, and a first outer conductor segment surrounding the first inner conductor segment. The antenna segment may include a second inner conductor segment coupled to the first inner conductor segment, and a second outer conductor segment surrounding the second inner conductor segment and coupled to the first outer conductor segment, the second inner conductor segment extending from the second outer conductor segment. Advantageously, the antenna segment may provide an efficient antenna structure with reduced common mode current.

In particular, the S-shaped balun segment may comprise first and second bends therein. Each of the first and second bends may define a reverse of direction.

For example, the antenna segment may have an operating wavelength associated therewith, and the first and second turns may be spaced apart a length in a range of 0.1 to 0.3 of the operating wavelength. The second inner conductor segment may extend outwardly from the second outer conductor segment a length in a range of 0.1 to 0.3 of the operating wavelength. Also, the coaxial cable device may have a diameter d, and the S-shaped balun segment may have a width in a range of 4 d to 6 d. The coaxial cable device may have a diameter d, and the second inner conductor segment may have a diameter in a range of 0.2 d to 0.4 d.

In some embodiments, the S-shaped balun segment may further comprise a wire extension coupled between spaced apart points of the first outer conductor segment. The antenna segment may operate without a ground plane. In other embodiments, the electronic device may further comprise a core body defining a plurality of passageways therethrough, and the S-shaped balun segment may extend through the plurality of passageways.

Another aspect is directed to an electronic device that may comprise a coaxial cable device comprising an S-shaped balun segment, and an antenna segment coupled to the S-shaped balun segment. The S-shaped balun segment may comprise a first inner conductor segment, and a first outer conductor segment surrounding the first inner conductor segment. The antenna segment may include a second inner conductor segment coupled to the first inner conductor segment, and a second outer conductor segment surrounding the second inner conductor segment and coupled to the first outer conductor segment, the second inner conductor segment extending from the second outer conductor segment.

Yet another aspect is directed to a method for making an electronic device. The method may include forming a coaxial cable device comprising an S-shaped balun segment coupled to a wireless circuit, and an antenna segment coupled to the S-shaped balun segment. The S-shaped balun segment may include a first inner conductor segment, and a first outer conductor segment surrounding the first inner conductor segment. The antenna segment may comprise a second inner conductor segment coupled to the first inner conductor segment, and a second outer conductor segment surrounding the second inner conductor segment and coupled to the first outer conductor segment, the second inner conductor segment extending from the second outer conductor segment.

DETAILED DESCRIPTION

Figure 1A:
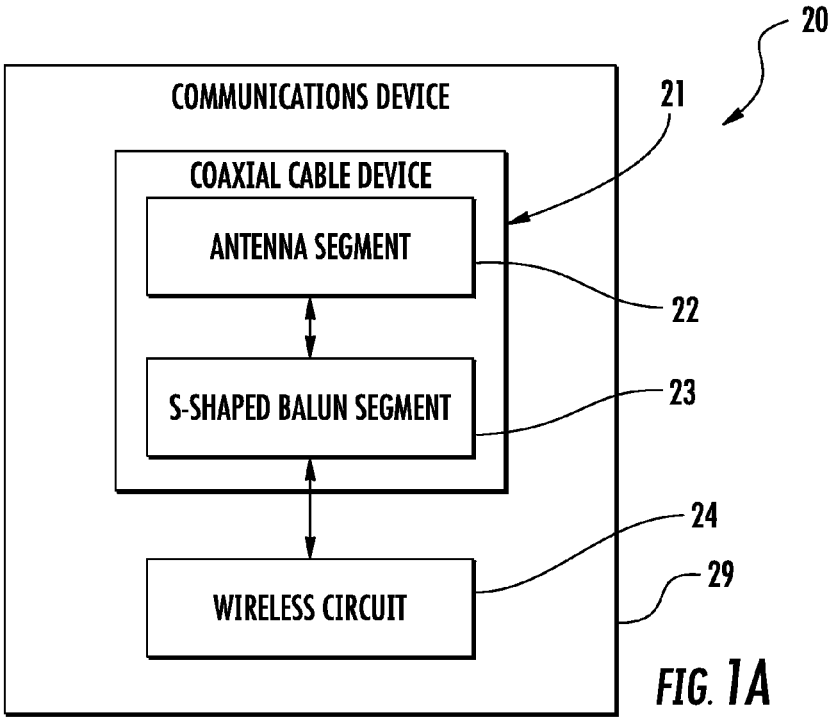
FIG. 1A is a schematic diagram of a communications device, according to the present invention.

The present disclosure will now be described more fully hereinafter with reference to the accompanying drawings, in which several embodiments of the invention are shown. This present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like numbers refer to like elements throughout, and prime notation is used to indicate similar elements in alternative embodiments.

Referring to FIGS. 1A-2B, an electronic device 100 according to the present invention is now described. In the illustrated embodiment, the electronic device 100 comprises a robot ground vehicle or an unmanned ground vehicle (UGV). The electronic device 100 illustratively includes a chassis 29, a camera 35 carried by the chassis, a plurality of wheels 34*a*-34*d* carried by the chassis, a robotic arm 33 carried by the chassis, and a communications device 20 carried by the chassis. In the illustrated embodiment, the chassis 29 comprises a metallic material (e.g. steel, aluminum), and includes radiation impeding components, such as the robotic arm 33, and the camera 35. Additionally, a robot vehicle is not a good shape for use as an antenna radiating element.

The communications device 20 illustratively includes a wireless circuit 24 (e.g. a wireless transceiver, a transmitter, or a receiver), and a coaxial cable device 21 coupled to the wireless circuit. The communications device 20 illustratively includes an S-shaped balun segment 23 coupled to the wireless circuit 24, and an antenna segment 22 coupled to the S-shaped balun segment. The antenna segment 22 may have an operating wavelength associated therewith, for example, 200-700 MHz. The S-shaped balun segment 23 comprises a first inner conductor segment 26, a first outer conductor segment 25 surrounding the first inner conductor segment, and a dielectric material (e.g. foam dielectric material) between the first inner conductor segment and the first outer conductor segment.

The antenna segment 22 includes a second inner conductor segment 28 coupled to the first inner conductor segment 26, a second outer conductor segment 27 surrounding the second inner conductor segment and coupled to the first outer conductor segment 25, and a dielectric material between the second inner conductor segment and the second outer conductor segment. As perhaps best seen in FIGS. 2A-2B, the second inner conductor segment 28 extends out of and past from the second outer conductor segment 27. The second inner conductor segment 28 may extend outwardly from the second outer conductor segment 27 a length in a range of 0.1 to 0.3 of the operating wavelength, preferably the illustrated 0.18 of the operating wavelength. In some embodiments, the antenna segment 22 may be formed from a coaxial cable by stripping off a portion of the outer conductor and dielectric material, thereby exposing the inner conductor. A suitable coaxial cable includes, for example, a RG-58 or RG-178 type coaxial cable. Although not depicted, the coaxial cable device 21 may also include a dielectric sheath surrounding the first and second outer conductor segments 25, 27, such a polyvinyl chloride (PVC) jacket.

Advantageously, the antenna segment 22 may provide an efficient antenna structure with reduced common mode current between the S-shaped balun segment 23 and the electronic device 100. Also, the antenna segment 22 may operate without a ground plane and provides a ground independent dipole antenna. In particular, the S-shaped balun segment 23 comprises first and second bends 31, 32 therein. Each of the first and second bends 31, 32 defines a reverse of direction. In other words, each of the first and second bends 31, 32 comprises a 180 degree turn in the opposite direction. Also, the portions of the coaxial cable device 21 between the bends 31, 32 are substantially parallel. In other embodiments, the S-shaped balun segment 23 comprises more than the first and second bends 31, 32 of the illustrated embodiment, which creates additional resonance frequencies.

The communications device 20 illustratively includes a core body 89 for the S-shaped balun segment 23. The core body 89 may define a plurality of passageways 38 therein. For the example dimensions given, the core body 89 material was polystyrene foam, which had negligible electrical effects. However, the core body 89 material may be a dielectric material, such as Teflon, or a magnetic material, such as a compressed powdered iron.

A method of the disclosure also includes providing the S-shaped balun segment 23 with an isoimpedance magnetodielectric material core body 89. An isoimpedance magnetodielectric material is one having a relative dielectric permittivity $\in_r$ and a relative magnetic permeability $\mu_r$ in about equal proportion, e.g. $(\mu_r \approx \in_r) > 1$. A example isoimpedance magnetodielectric core body 89 material includes light nickel zinc ferrite of controlled iron content, such as product number SMMGF101 sintered ferrite, as available from Spectrum Magnetics of Wilmington, Del., which has a controlled relative permittivity $\mu_r$ and a controlled relative permeability $\in_r$, both $\mu_r$ and $\in_r$ being in the range of 12 to 15, and a $\mu_r$ value within +−12 percent of $\in_r$. The advantages of a $(\mu_r \approx \in_r) > 1$ isoimpedance magnetodielectric core body 89 material may include miniaturization of the S-shaped balun segment 23 according to both the dielectric and magnetic constants, e.g. a miniaturization factor of approximately $1/\sqrt{(\mu_r \in_r)}$. A $\mu_r \approx \in_r$ magnetodielectric core body 89 material may be said to be an isoimpedance material as it has the same $120\pi = 377$ ohm intrinsic impedance of free space or nearly so, which adjusts core body 89 material reflections to electromagnetic waves.

A $(\mu_r \approx \in_r) > 1$ core body 89 provides an enhanced electromagnetic coupling between the approximately parallel portions of the coaxial cable device 21 between bends 31, 32, adjusting or broadening frequency response. Of course, the core body 89 may also provide mechanical and manufacturing benefits, such as in forming and retaining S-shaped balun segment 23 shapes.

Many more applications will be apparent for the S-shaped balun segment 23, including those without an antenna segment 22. For instance an S-shaped balun segment 23 may be formed in computer cords, such as a coaxial cable type computer cords connected between a computer chassis and a monitor display unit in order to suppress electromagnetic interference (EMI). An S-shaped balun segment 23 may be adjusted to resonate at an interference frequency. In another application, the S-shaped balun segment 23 can be used to transition from a coaxial cable to open wire transmission line. The S-shaped balun segment 23 may be formed in a cable other than coaxial cable, such as forming an S-shaped balun segment 23 in a twisted pair transmission line. Forming an S-shaped balun segment 23 in a twisted pair category 5 Ethernet cable may reduce cross talk between the bundled by suppressing unwanted modes. The S-shaped balun segment 23 may prevent radiated EMI when formed in AC power cords, such as those powering fluorescent lights power. There may be multiple baluns segments 23 in different places along a cable.

Figure 2A:
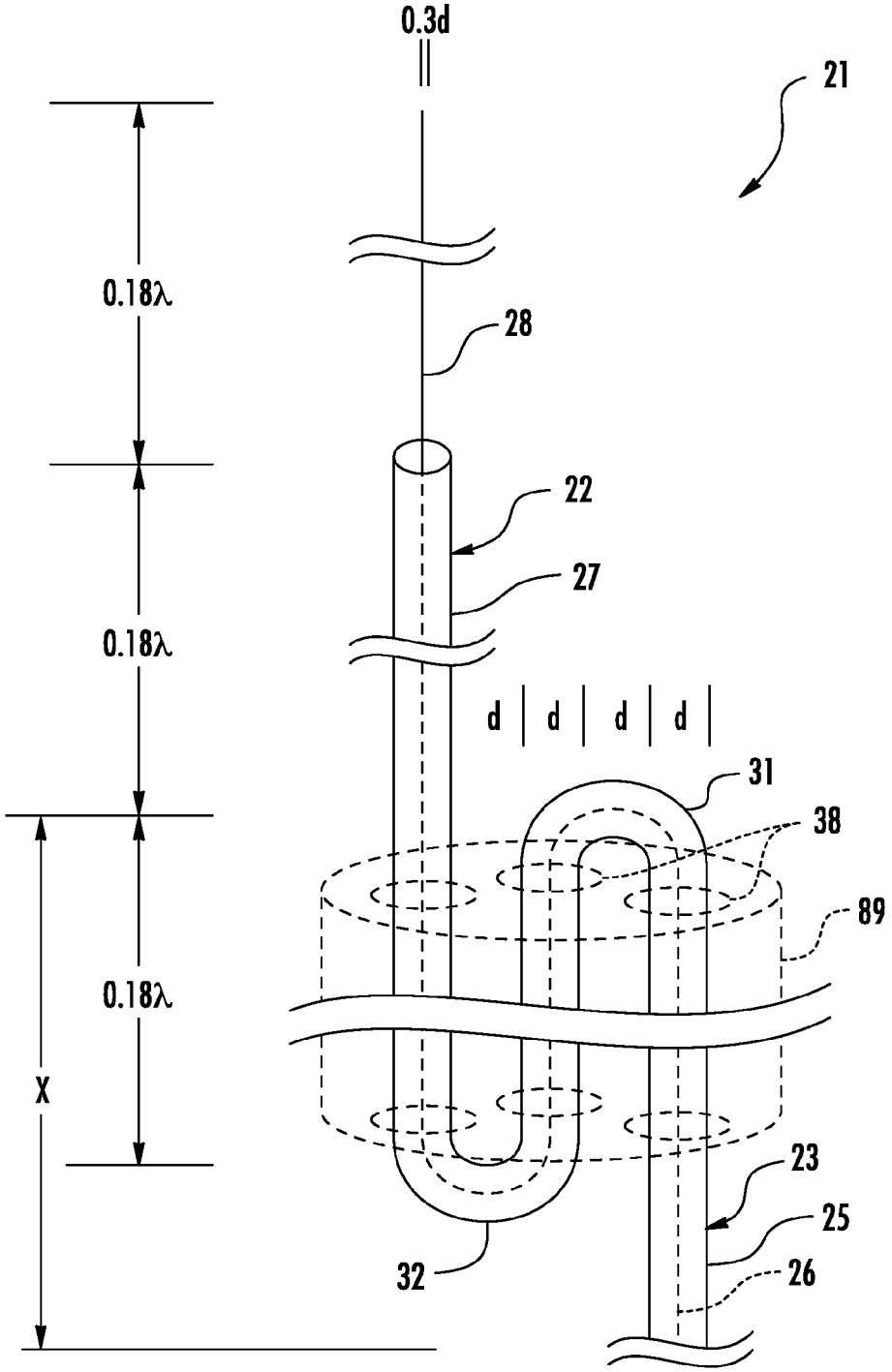
FIGS. 2A and 2B are schematic diagrams of the coaxial cable device from the devices of FIGS. 1A-1B.

As perhaps best seen in FIG. 2A, the first and second bends 31, 32 may be spaced apart a length in a range of 0.1 to 0.3 of the operating wavelength, preferably the illustrated 0.18 of the operating wavelength. Also, the coaxial cable device 21 may have a diameter d, and the S-shaped balun segment 23 may have a width in a range of 4 d to 6 d, preferably the illustrated 5 d. The coaxial cable device 21 may have a diameter d, and the second inner conductor segment 28 may have a diameter in a range of 0.2 d to 0.4 d, preferably the illustrated 0.3 d.

Figure 1B:
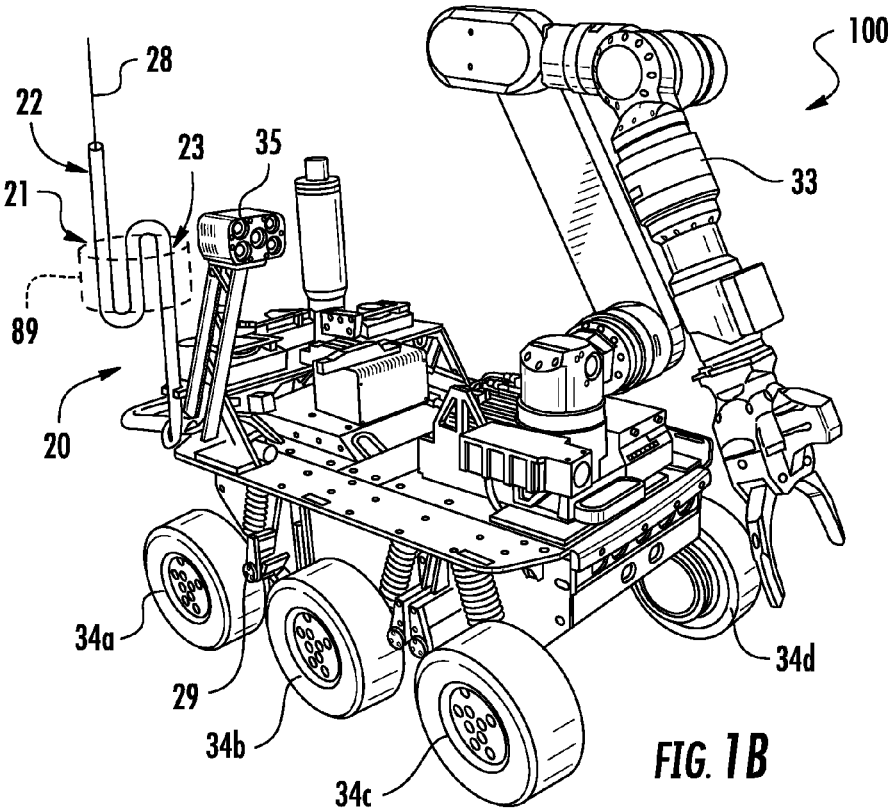
FIG. 1B is a perspective view of an embodiment of an electronic device, according to the present invention.
Figure 2B:
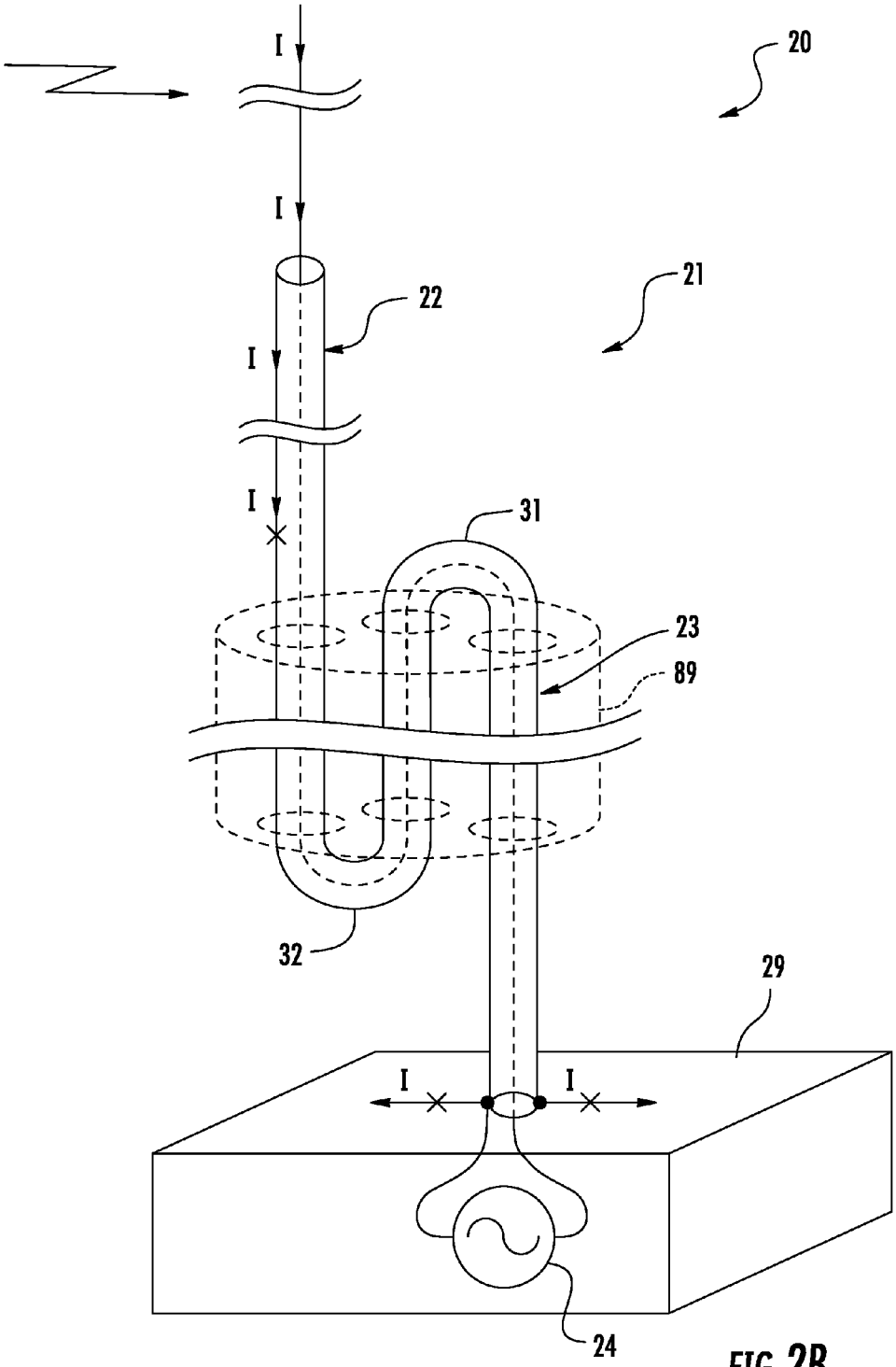

As perhaps best seen in FIGS. 1B and 2B, the S-shaped balun segment 23 provides a common mode current choke and prevents the common mode current on the outside of the coaxial cable from flowing onto the chassis 29. This is in stark contrast to prior art approaches for UGVs using monopole whip antennas, where the chassis 29 operates as a poor ground plane. In UGV applications, the robot ground vehicle is a complex structure that is not favorably shaped to be a portion of the antenna or antenna "ground plane." Hence, in the prior art approach, an irregular radiation pattern results with nulls, blockages, radiation pattern ground tuck, and fades. Moving parts of the UGV further shade the pattern, such as the robotic arm 33 and the camera 35. In the communications device 20, due to the S-shaped balun segment 23, the common mode current does not flow through the chassis 29, which improves antenna efficiency and the radiation pattern. FIG. 2B illustrates that the radiating mode currents do not extend beyond the S-shaped balun segment 23 and that radiating currents do flow onto the chassis 29 exterior. RF electrical currents inside the coaxial cable are of course unaffected by the S-shaped balun segment 23 bends.

The bending of the coaxial cable device 21 prevents the RF currents from flowing on the surface of the mobile radio platform, i.e. the chassis 29. The coaxial cable portions above the first and second bends 31, 32 form a dipole. Allowing RF currents to spill out over the cable shield exterior forms the lower half element of the dipole. The resulting antenna is ground free, e.g. the mobile radio platform is not part of the antenna electrically. The coaxial cable shield between the dipole feed point and the S-shaped balun segments 23 may carry two different currents flows: 1) the conventional coaxial cable return current flow on the inside surface of the coaxial cable shield and 2) the common mode radiating current on the outside of the coaxial cable shield. So the currents on the inside and outside of the coaxial cable shield may flow in different directions at the same time. This can occur because the coaxial cable shield can be many RF skin depths thick at radio frequencies.

Another aspect is directed to a balun device that may comprise a coaxial cable device 21 comprising an S-shaped balun segment 23, and an antenna segment 22 coupled to the S-shaped balun segment. The balun device would be coupled between unbalanced first and second devices. The S-shaped balun segment 23 may comprise a first inner conductor segment 26, and a first outer conductor segment 25 surrounding the first inner conductor segment. The antenna segment 22 may include a second inner conductor segment 28 coupled to the first inner conductor segment 26, and a second outer conductor segment 27 surrounding the second inner conductor segment and coupled to the first outer conductor segment, the second inner conductor segment extending from the second outer conductor segment.

A further aspect is directed to a communications device 20 that may include a wireless circuit 24, and a coaxial cable device 21 having an S-shaped balun segment 23 coupled to the wireless circuit, and an antenna segment 22 coupled to the S-shaped balun segment. The S-shaped balun segment 23 may include a first inner conductor segment 26, and a first outer conductor segment 25 surrounding the first inner conductor segment. The antenna segment 22 may include a second inner conductor segment 28 coupled to the first inner conductor segment 26, and a second outer conductor segment 27 surrounding the second inner conductor segment and coupled to the first outer conductor segment 25, the second inner conductor segment extending from the second outer conductor segment.

Yet another aspect is directed to a method for making a communications device 20. The method may include forming or coupling a coaxial cable device 21 comprising an S-shaped balun segment 23 coupled to a wireless circuit 24, and an antenna segment 22 coupled to the S-shaped balun segment. The S-shaped balun segment 23 may include a first inner conductor segment 26, and a first outer conductor segment 25 surrounding the first inner conductor segment. The antenna segment 22 may comprise a second inner conductor segment 28 coupled to the first inner conductor segment 26, and a second outer conductor segment 27 surrounding the second inner conductor segment and coupled to the first outer conductor segment, the second inner conductor segment extending from the second outer conductor segment.

Figure 8:
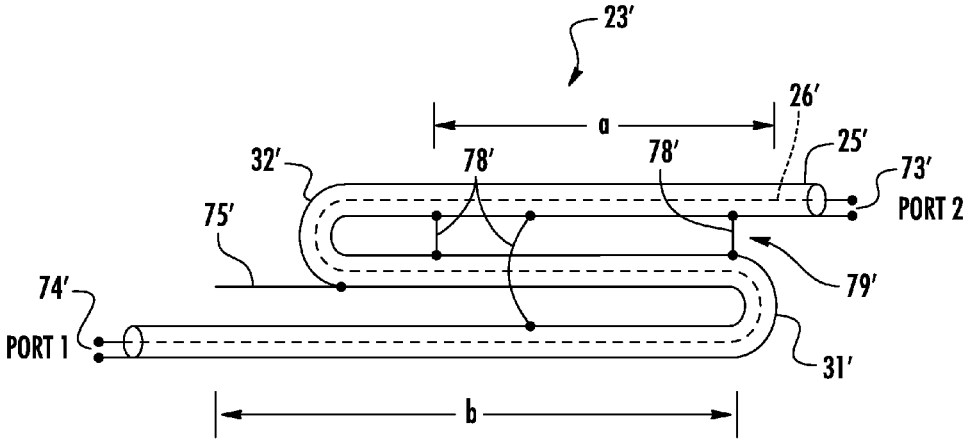
FIG. 8 is a schematic diagram of a balun device according to the present invention.
Figure 9:
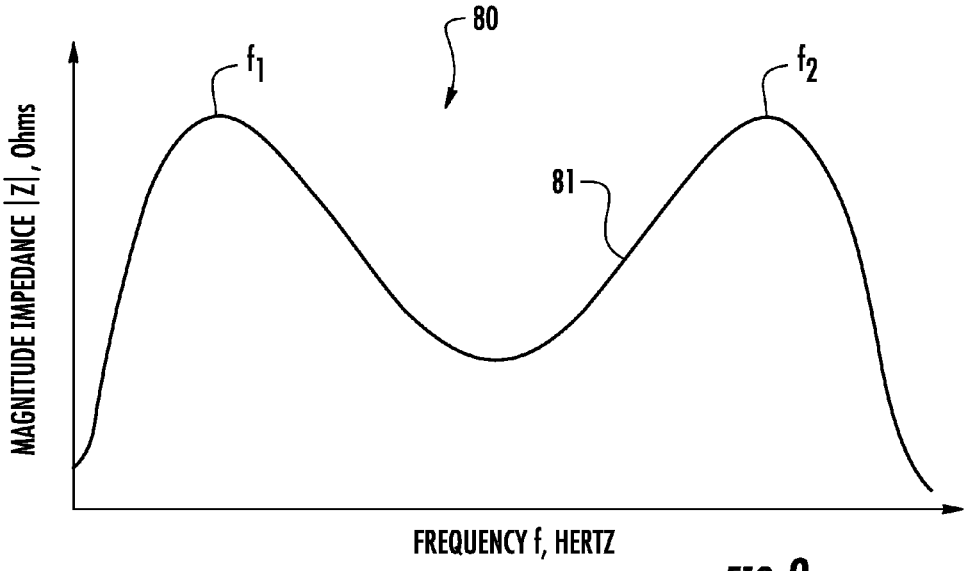
FIG. 9 is a diagram of common mode impedance for the balun device of FIG. 8.

Referring now additionally to FIGS. 8-9, another embodiment of the S-shaped balun segment 23' is now described. In this embodiment of the S-shaped balun segment 23' , those elements already discussed above with respect to FIGS. 1A-3 are given prime notation and most require no further discussion herein. This embodiment differs from the previous embodiment in that this S-shaped balun segment 23' further comprises a wire extension 75' coupled between spaced apart points of the first outer conductor segment 25'. The wire extension(s) 75' is electrically coupled to the first outer conductor segment 25'. One or more wire extension(s) 75' may be present to advantageously permit additional electrical adjustments of the balun 23'. For instance, a wire extension 75' may lower a frequency response of the S-shaped balun segment 23'. The embodiment may also include one or more electrical connections 78' between coaxial cable shields, such as say electrical connections 78' being provided by metallic clamps or soldered jumper wires. Electrical connections 78' may also further electrically adjust balun 23'. For instance, an electrical connection placed near an open end 79' eliminates or nearly the electrical effects of a cable reversal. This embodiment also includes ports 1 and 2, 74', 73' for coupling to the first inner and outer conductor segments 25', 26'.

Dimension a may be resonant at a first frequency $f_1$ and dimension b may be resonant at a second frequency $f_2$, although other lengths for a and b may be used, such as Chebyshev tunings, dimensions a=b, or even non-resonant dimensions for a and b. In fact, most lengths of dimensions a and b provide some functionality. Diagram 80 includes curve 81 which shows a type of magnitude impedance response to common mode currents on the S-shaped balun segment 23'. The curve 81 illustratively includes 2 staggered tuned resonance frequencies, i.e. $f_1$, $f_2$ and the S-shaped balun segment 23' can render broad band operation with a determined pass band ripple. More peaks and ripples and bandwidth are possible with increasing numbers of S-shaped balun segments 23.

Advantageously, in either direction, surface currents can get trapped in a resonant quarter-wave cable choke. In structural sizes away from resonance, surface currents can get impeded by inductive reactance. In some embodiments, the S-shaped balun segment 23' may comprise more than the illustrated first and second bends 31, 32, and more than the illustrated single wire extension 75', which may provide more resonances and bandwidth. For example, 3 bends may be configured, with 2 wire extensions, and 3 resonances formed.

Figure 3:
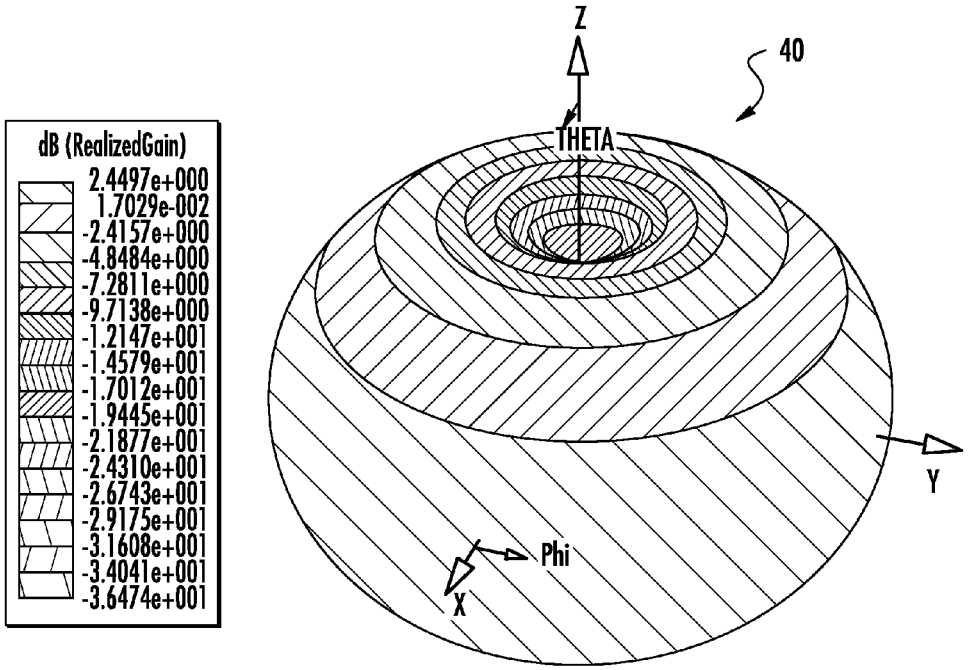
FIG. 3 is a diagram of a far field radiation pattern for the antenna segment from the devices of FIGS. 1A-1B.
Figures 4A, 4B, 4C:
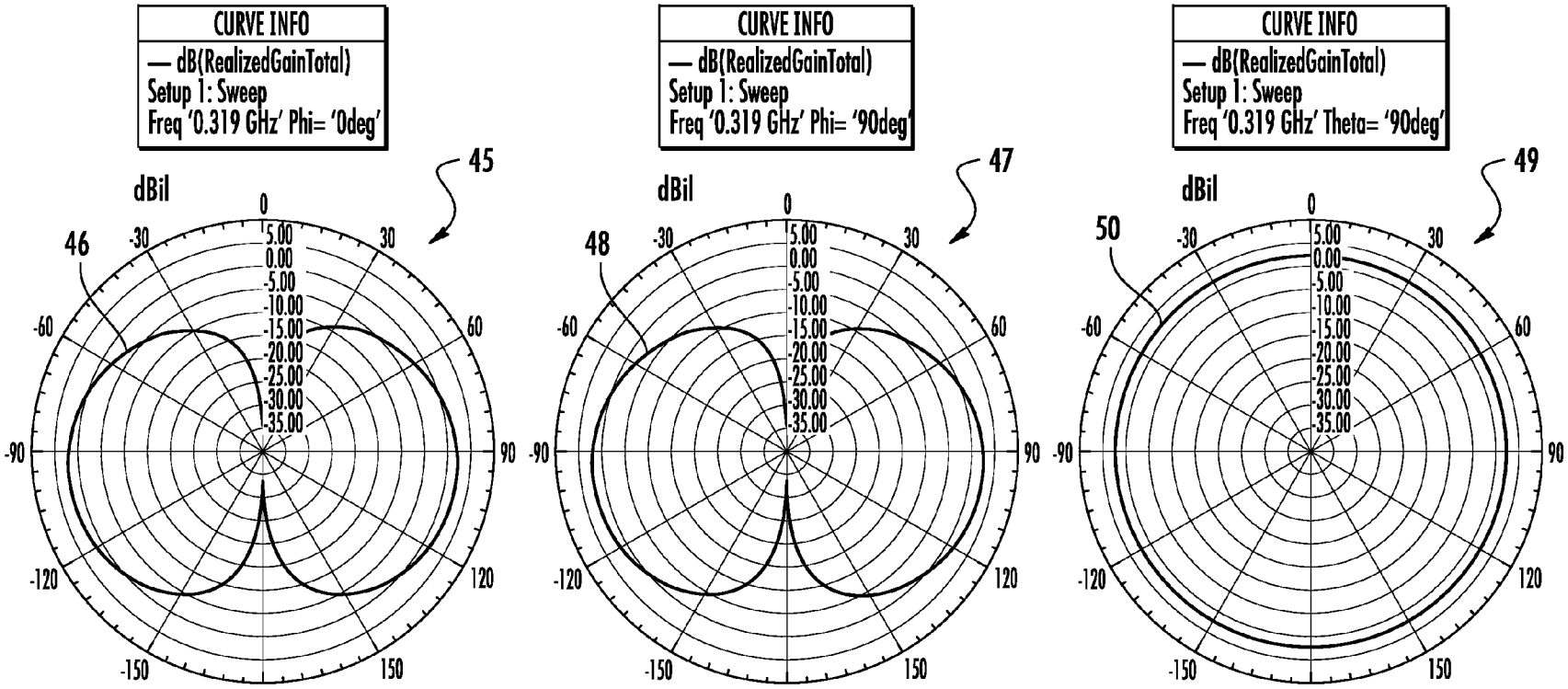
FIGS. 4A-4C are diagrams of the far field radiation pattern for the antenna segment from the devices of FIGS. 1A-1B along the XZ plane, the YZ plane, and the XY plane, respectively.
Figure 5:
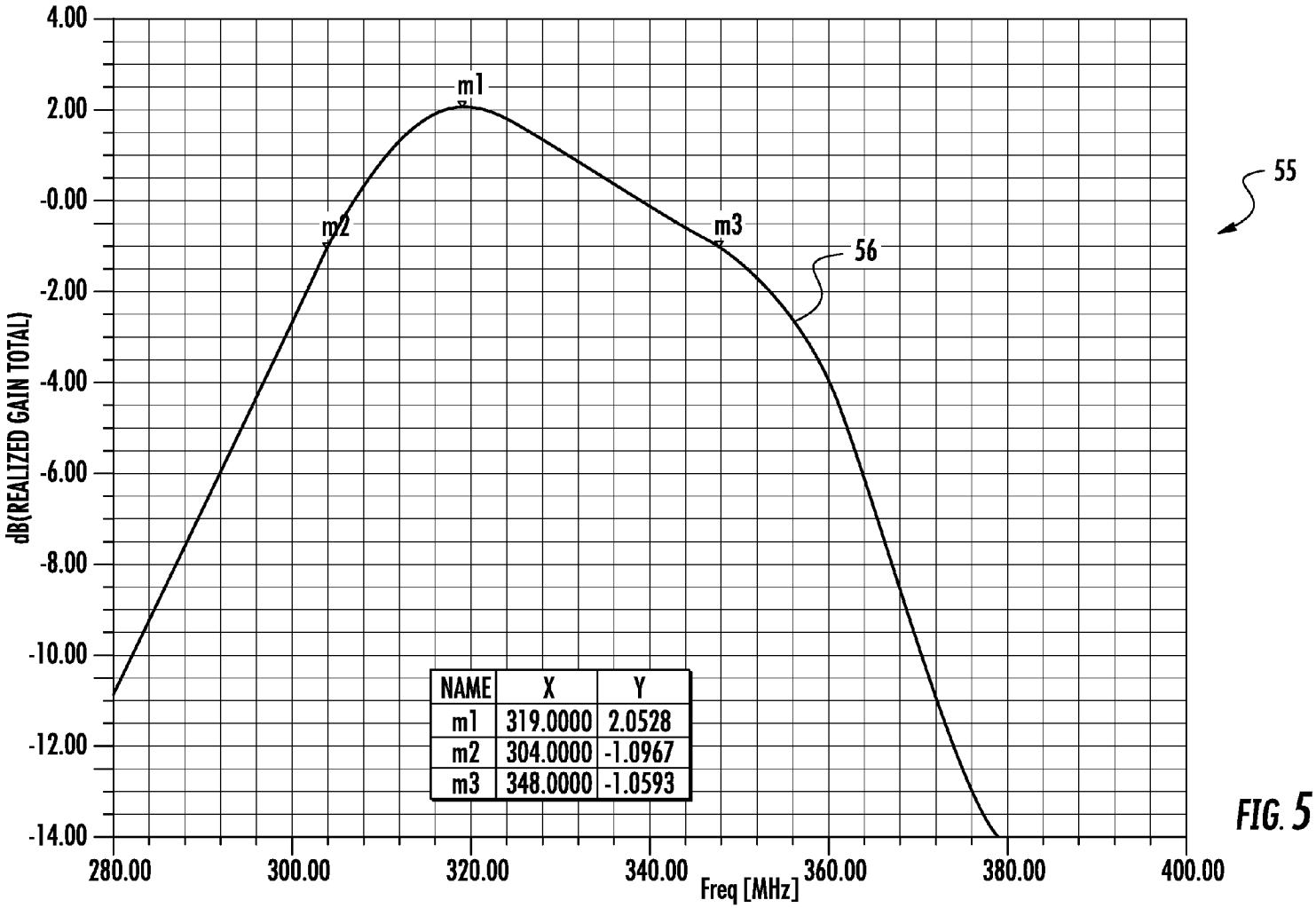
FIG. 5 is a diagram of gain response for the antenna segment from the devices of FIGS. 1A-1B.

Referring now to FIGS. 3-7 and 9, the performance characteristics of the communications device 20 are now discussed. In particular, the simulations relate to the embodiment shown in FIG. 1B. In FIG. 3, diagram 40 is a three dimensional view of the far field radiation pattern for the communications device 20 and as can be seen, the radiation pattern is approximately toroidal. In FIGS. 4A-4C, diagrams 45, 47, 49 respectively include curves 46, 48, 50 for showing the principal plane cuts (i.e. XZ plane, YZ plane, and XY plane two dimensional slices) of the far field radiation pattern of the communications device 20. The radiation pattern lobes are oriented broadside the antenna axis and the pattern nulls are oriented approximately along the axis of the antenna structure. Advantageously, the communications device 20 realizes a +2 dBil realized gain, and $\cos^2\theta$ two petal rose radiation pattern similar to the pattern of the canonical half-wave dipole. Diagram 55 includes curve 56 for showing the swept realized gain, e.g. frequency response of the communications device 20 across frequencies 280-380 MHz in range. The canonical thin wire half wave dipole has a quadratic frequency response and while the communications device 20 dipole gave a lightly coupled $4^{th}$ order Chebyshev response. Advantageously, the S-shaped segments 23 rendered impedance compensation to the dipole radiating portion and an increased antenna radiation bandwidth resulted relative a conventional thin wire half wave dipole antenna.

Figure 6:
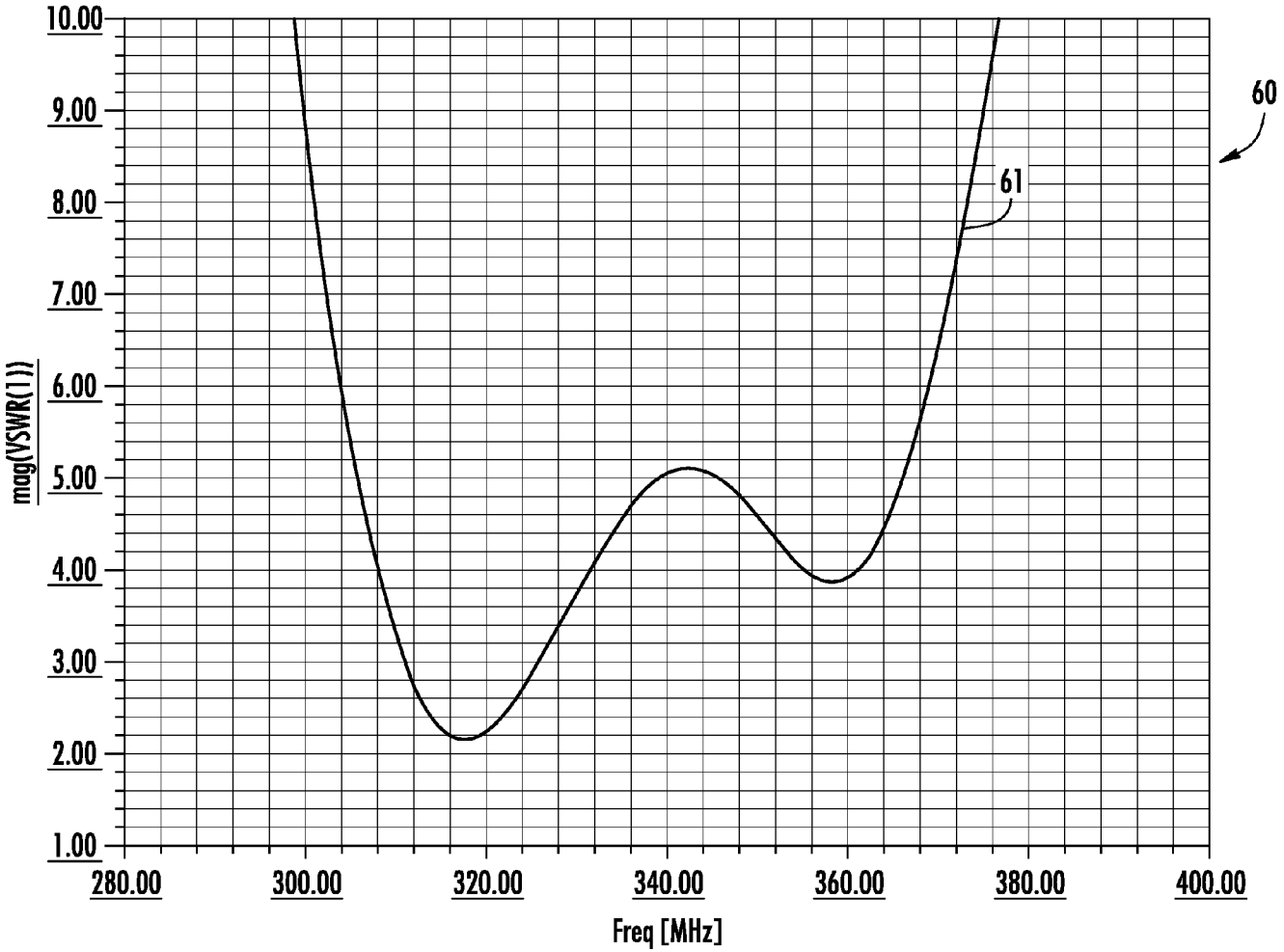
FIGS. 6 and 7 are diagrams of simulated and actual measured voltage standing wave ratio for the antenna segment from the devices of FIGS. 1A-1B, respectively.
Figure 7:
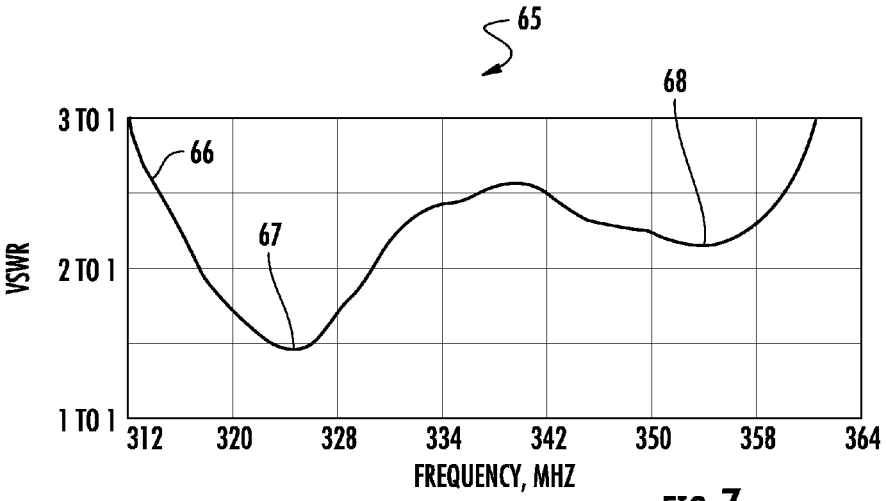

In FIG. 6, diagram 60 includes curve 61 for showing a simulated VSWR response for the communications device 20 in a 50 ohm system. Additionally, in FIG. 7, diagram 65 includes curve 66 for showing an actual measured VSWR for an example implementation of the communications device 20. Points 67 (326.621 MHz), 68 (353.851 MHz) may demonstrate respectively the dipole natural and balun compensated resonances.

Figure 10:
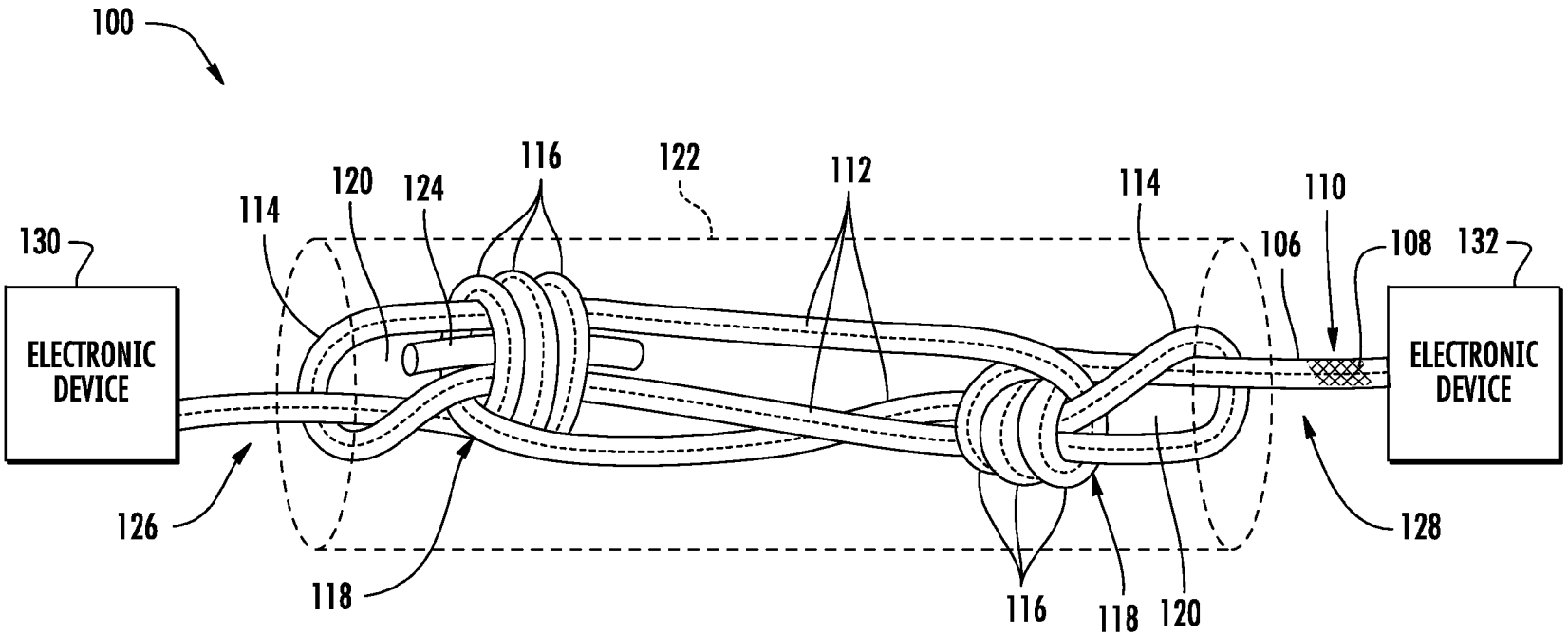
FIG. 10 is a diagram of an embodiment of a self binding balun device.

Referring to FIG. 10, diagram 100, a self binding balun 102 embodiment will now be described. This embodiment may be simply formed by tying a knot in a cable. Apparatus 130, 132 are interconnected by a flexible coaxial cable 106. The apparatus 130, 132 may be say a radio transceiver 102 and an antenna 104, or digital devices such as a visual display 102 and computer chassis 104, or others as may benefit from a balun there between. The flexible coaxial cable 106 may have a conductive shield of woven wire 108 and may be covered with an outer jacket 110 of nonconductive plastic such as PVC or Teflon. Suitable coaxial cable 106 includes type RG-58 coaxial cable. S shaped segments 112 are formed by doubling the coaxial cable 106 back upon itself using U-bends 114. In the diagram 100 self binding embodiment an interlacement of the coaxial cable 106 secures the S shaped choking segments 112. This interlacement may include one or more loops 116. The interlacement secures the loops 116 with elbow 118. The free ends 126, 128 of the coaxial cable 106 are prevented from spillage by capture through eyes 120 of the U-bends 114. Thus the balun 102 shape cannot spill even for low friction outer jacket 110 materials, such as say Teflon type outer jacket 110 materials.

Loops 116 may beneficially function electrically as inductor turns, one or a plurality in number of loops 116 may be formed by repeatedly curling the coax cable 106 over the S shaped segments 112. One or more core bodies 124 may be included inside the loop 116 turns in some embodiments, although the balun 102 may be formed without them is desired. Electrical response of the loops 116 and the balun 102 may adjust by core body 124 dimensions and materials. The core bodies 124 also may be a magnetic material, or a nonmagnetic material such as flexible polyethylene plastic rod, which increases choking inductance by increasing loop 116 diameter.

A proximal material 122 may enclose or partially so the balun 102 to increase balun 102 effectiveness. The proximal material may be molded over the balun 102 after balun 102 fabrications, or the proximal material 122 may be created prior to balun 102 manufacture, as a "core" with prefitted holes to accept the coaxial cable 106. The proximal material 102 material may have an approximately equal relative permittivity $\mu_r$ and equal relative permeability $\in_r$, e.g. $\mu_r=\in_r$, say within +−50 percent of one another. Advantageously, equal relative permittivity equal relative permeability proximal material 122 has an intrinsic impedance of 120π ohms for all values of $\mu_r=\in_r$, which equally matches the 120π ohms characteristic impedance of free space. An example isoimpedance proximal material 122 material may be light nickel zinc ferrite, such as product number SMMGF101 material by Spectrum Magnetics, 1210 first State Blvd., Wilmington, Del. 19804. SMMGF101 has a controlled relative permittivity and a controlled relative permeability keeping $\mu_r \approx \in_r$ and in the range of 12 to 15. Another suitable isoimpedance proximal material 122 material is a mixture of pentacarbonyl E iron powder grade CIP ER vended by BASF of Ludwigshafen, Germany; combined with barium titanate $BaTiO_3$ powder (fungible); combined with product number A16 glass microspheres as vended by 3M of Saint Paul, Minn; and combined with GE RTV 560 silicon rubber. By weight an approximate proportion is E iron 40 percent, silicon rubber 54 percent, barium titanate 3 percent, glass microspheres 3 percent. An $(\mu_r=\in_r)>1$ proximal material 122 provides dissipation of surface waves attached to the coax cable 106 over a broad frequency range. This is because waves, surface waves, and currents enter a $\mu_r=\in_r$ proximal material without reflection. Dissipation is enhanced in a $(\mu_r=\in_r)>1$ proximal material 122 as wave velocity can be can be slow causing a long electrical path length to exist in the proximal material 122. More path length may cause more absorption of electromagnetic energies. The approximately propagation velocity in a $(\mu_r=\in_r)>1$ proximal material 122 is $v=c/\sqrt{(\mu_r\in_r)}$, where c is the speed of light in free space.

Figure 11:
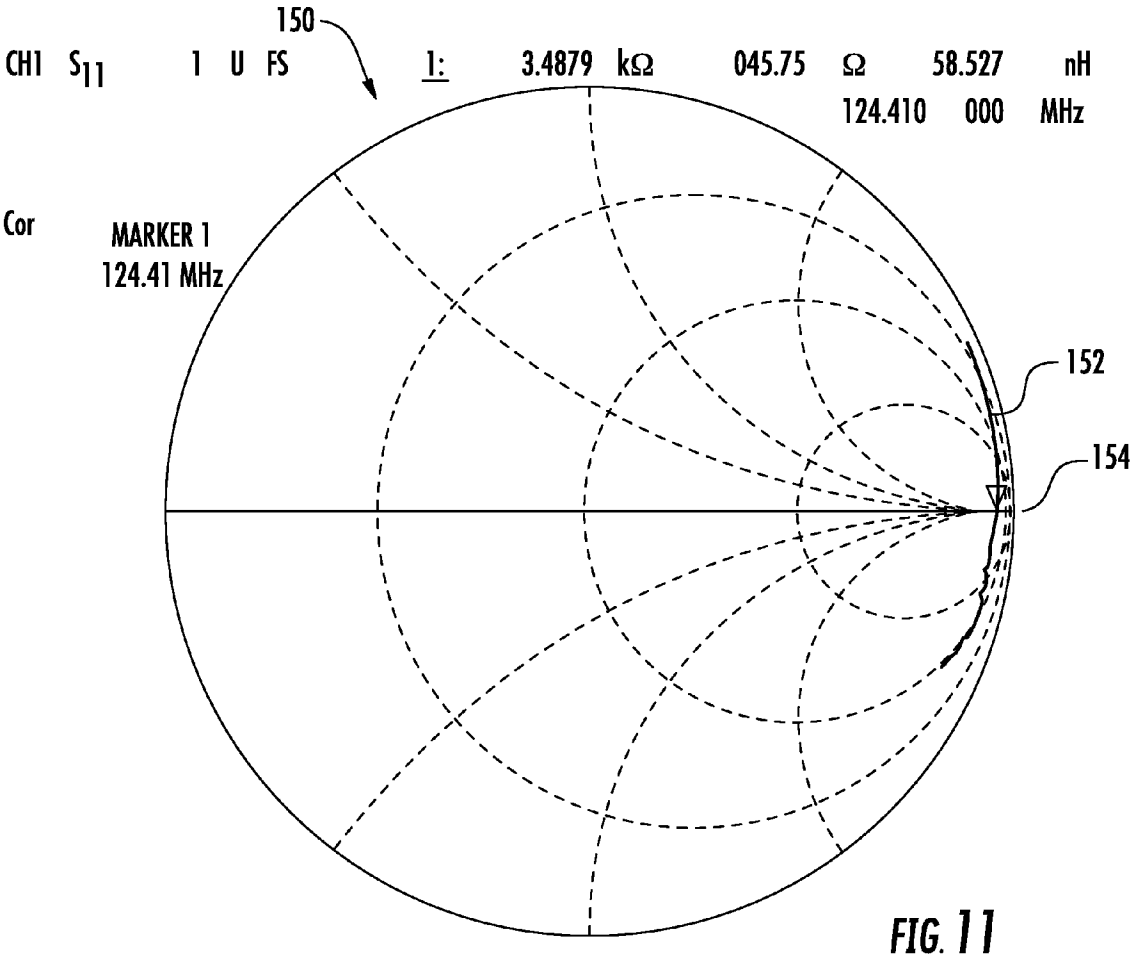
FIG. 11 is a diagram of the measured impedance of an example embodiment of the self binding embodiment balun device from FIG. 10.

In FIG. 11, diagram 150 depicts the measured common mode choking impedance of a prototyped embodiment of the FIG. 10 balun 102. The prototype measured 3 inches long and 1 inches in diameter and coaxial cable 106 was a RG-58 coaxial cable. The quantity of S shaped segments 112 was 3 and the quantity of loops 116 was 6 in total. The proximal material 102 was air, e.g. in this instance no proximal material 102 was present. Trace 152 is the common mode choking impedance measured at connections to the coax shield braids at free ends 126, 128. Marker 154 shows this impedance to be Z=3488+j45 ohms at 124 MHz. Of course, the coaxial cable 106 continued to function internally as a 50 ohm characteristic impedance coaxial cable with low losses to differential mode signals being conveyed internally.

Figure 12A:
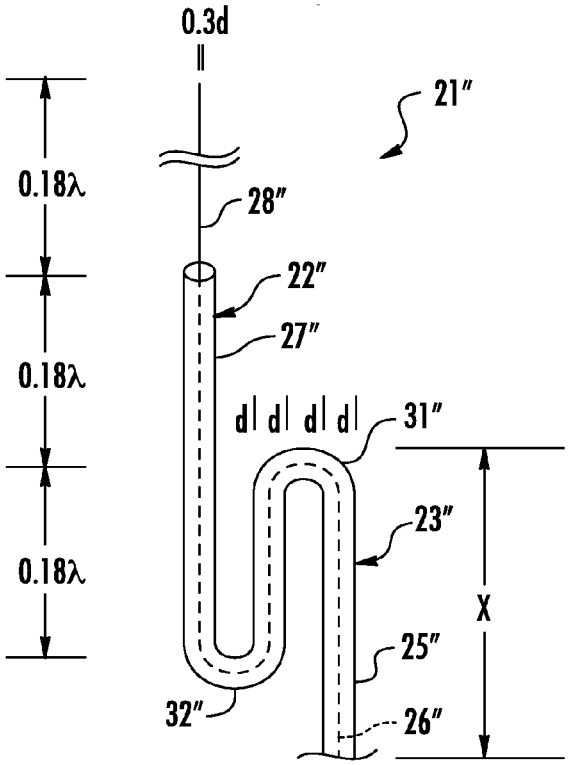
FIGS. 12A and 12B are schematic diagrams of another embodiment of the coaxial cable device from the devices of FIGS. 1A-1B.
Figure 12B:
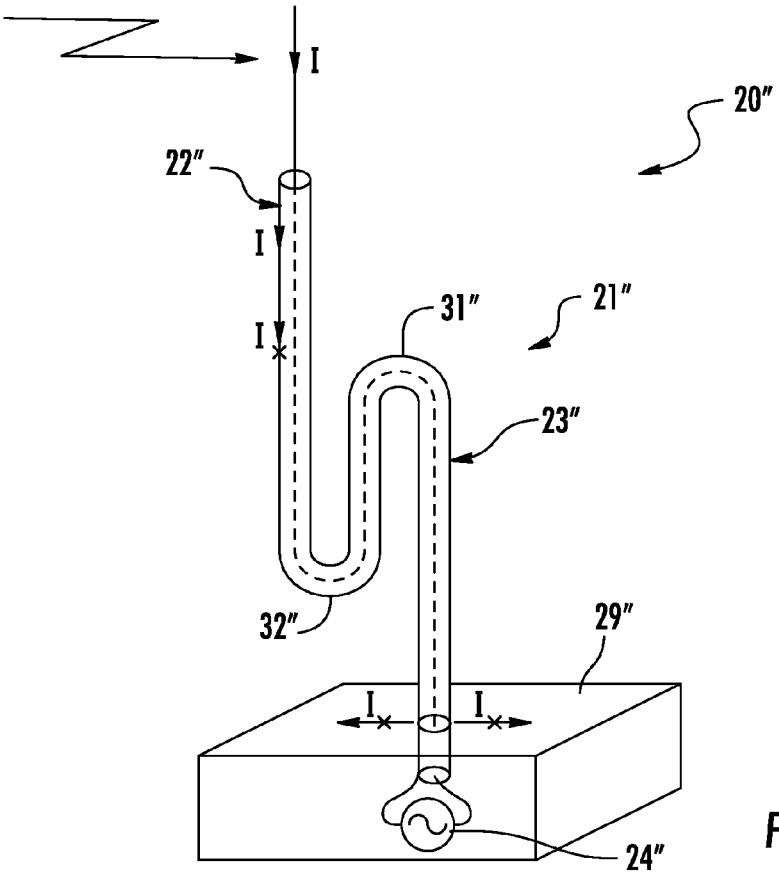

Referring now additionally to FIGS. 12A-12B, another embodiment of the coaxial cable device 21" is now described. In this embodiment of the coaxial cable device 21" , those elements already discussed above with respect to FIGS. 2A-2B are given double prime notation and most require no further discussion herein. This embodiment differs from the previous embodiment in that this coaxial cable device 21" does not include the core body.

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

That which is claimed is:

1. An electronic device comprising:

a wireless transceiver;

a coaxial cable device comprising an S-shaped balun segment coupled to said wireless transceiver, and an antenna segment coupled to said S-shaped balun segment;

said S-shaped balun segment comprising a first inner conductor segment, and a first outer conductor segment surrounding said first inner conductor segment;

said S-shaped balun segment comprising first and second bends, and a straight section between the first and second bends;

said antenna segment comprising a second inner conductor segment coupled to said first inner conductor segment, and a second outer conductor segment surrounding said second inner conductor segment and coupled to said first outer conductor segment, said second inner conductor segment extending from said second outer conductor segment; and a core body defining at least three passageways therethrough, said S-shaped balun segment meandering through the at least three passageways.

2. The electronic device of claim 1 wherein each of said first and second bends defines a reverse of direction.

3. The electronic device of claim 1 wherein said antenna segment has an operating wavelength associated therewith; and wherein said first and second turns are spaced apart a length in a range of 0.1 to 0.3 of the operating wavelength.

4. The electronic device of claim 1 wherein said antenna segment has an operating wavelength associated therewith; and wherein said second inner conductor segment extends outwardly from said second outer conductor segment a length in a range of 0.1 to 0.3 of the operating wavelength.

5. The electronic device of claim 1 wherein said coaxial cable device has a diameter d; and wherein said S-shaped balun segment has a width in a range of 4 d to 6 d.

6. The electronic device of claim 1 wherein said coaxial cable device has a diameter d; and wherein said second inner conductor segment has a diameter in a range of 0.2 d to 0.4 d.

7. The electronic device of claim 1 wherein said S-shaped balun segment further comprises a wire extension coupled between spaced apart points of said first outer conductor segment.

8. The electronic device of claim 1 wherein said antenna segment operates without a ground plane.

9. An electronic device comprising:

a coaxial cable device comprising an S-shaped balun segment, and an antenna segment coupled to said S-shaped balun segment;

said S-shaped balun segment comprising a first inner conductor segment, and a first outer conductor segment surrounding said first inner conductor segment;

said antenna segment comprising a second inner conductor segment coupled to said first inner conductor segment, and a second outer conductor segment surrounding said second inner conductor segment and coupled to said first outer conductor segment, said second inner conductor segment extending from said second outer conductor segment;

said S-shaped balun segment comprising first and second bends, and a straight section between the first and second bends; and a core body defining at least three passageways therethrough, said S-shaped balun segment meandering through the at least three passageways.

10. The electronic device of claim 9 wherein each of said first and second bends defines a reverse of direction.

11. The electronic device of claim 9 wherein said antenna segment has an operating wavelength associated therewith; and wherein said first and second turns are spaced apart a length in a range of 0.1 to 0.3 of the operating wavelength.

12. The electronic device of claim 9 wherein said coaxial cable device has a diameter d; and wherein said S-shaped balun segment has a width in a range of 4 d to 6 d.

13. The electronic device of claim 9 wherein said coaxial cable device has a diameter d; and wherein said second inner conductor segment has a diameter in a range of 0.2 d to 0.4 d.

14. A method for making an electronic device comprising:

forming a coaxial cable device comprising an S-shaped balun segment coupled to a wireless transceiver, and an antenna segment coupled to the S-shaped balun segment;

the S-shaped balun segment comprising a first inner conductor segment, and a first outer conductor segment surrounding the first inner conductor segment;

the S-shaped balun segment comprising first and second bends, and a straight section between the first and second bends;

the antenna segment comprising a second inner conductor segment coupled to the first inner conductor segment, and a second outer conductor segment surrounding the second inner conductor segment and coupled to the first outer conductor segment, the second inner conductor segment extending from the second outer conductor segment; and positioning a core body defining at least three passageways therethrough so that the S-shaped balun segment meanders through the at least three passageways.

15. The method of claim 14 wherein each of the first and second bends defines a reverse of direction.

16. The method of claim 14 wherein the antenna segment has an operating wavelength associated therewith; and wherein the first and second turns are spaced apart a length in a range of 0.1 to 0.3 of the operating wavelength.

17. The method of claim 14 wherein the antenna segment has an operating wavelength associated therewith; and wherein the second inner conductor segment extends outwardly from the second outer conductor segment a length in a range of 0.1 to 0.3 of the operating wavelength.

18. The electronic device of claim 1 wherein each of said first and second bends comprises a 180 degree turn.

19. The electronic device of claim 9 wherein each of said first and second bends comprises a 180 degree turn.

20. The method of claim 14 wherein each of the first and second bends comprises a 180 degree turn.

21. The method of claim 14 wherein the coaxial cable device has a diameter d; and wherein the S-shaped balun segment has a width in a range of 4 d to 6 d.

22. The method of claim 14 wherein the coaxial cable device has a diameter d; and wherein the second inner conductor segment has a diameter in a range of 0.2 d to 0.4 d.

* * * * *